US006243988B1

(12) United States Patent
Salice

(10) Patent No.: US 6,243,988 B1
(45) Date of Patent: Jun. 12, 2001

(54) ACTUATING DEVICE FOR A CLOSING ELEMENT MOVABLE IN A VERTICAL DIRECTION

(75) Inventor: Luciano Salice, Carimate (IT)

(73) Assignee: Arturo Salice S.P.A., Novedrate/Como (IT)

( * ) Notice: Subject to any disclaimer, the term of this patent is extended or adjusted under 35 U.S.C. 154(b) by 0 days.

(21) Appl. No.: 09/362,122

(22) Filed: Jul. 28, 1999

(30) Foreign Application Priority Data

Jul. 28, 1998 (DE) ..... 298 13 452 U
Apr. 22, 1999 (EP) ..... 99108013

(51) Int. Cl.[7] ..... E05F 1/00
(52) U.S. Cl. ..... 49/445; 49/125; 49/127
(58) Field of Search ..... 49/128, 129, 127, 49/125, 211, 213, 214, 215, 445, 446, 447

(56) References Cited

U.S. PATENT DOCUMENTS 884,472 * 4/1908 Daly ..... 49/447
3,977,123 * 8/1976 Clay et al. ..... 49/125 X
4,845,890 * 7/1989 Terada et al. ..... 49/128 X
4,949,425 8/1990 Dodson et al. ..... 16/198

FOREIGN PATENT DOCUMENTS 245782 7/1965 (AT) .
40 13 571 10/1991 (DE) .
693 13 879 1/1998 (DE) .
298 07 679 U 9/1998 (DE) .
0 357 214 3/1990 (EP) .
0 417 822 3/1991 (EP) .
2 504 182 10/1982 (FR) .
329 286 5/1930 (GB) .

* cited by examiner

*Primary Examiner*—Jerry Redman
(74) *Attorney, Agent, or Firm*—Jacobson, Price, Holman & Stern, PLLC

(57) ABSTRACT

The invention relates to an actuating device for a closing element movable in a vertical direction within openings which are guided in lateral guides, with the door weight being taken up by a spring-loaded tension element or being compensated by a counterweight.

19 Claims, 9 Drawing Sheets

ACTUATING DEVICE FOR A CLOSING ELEMENT MOVABLE IN A VERTICAL DIRECTION

BACKGROUND OF THE INVENTION

1. Field of the Invention

The invention relates to an actuating device for a closing element movable in a vertical direction for openings of all kinds, preferably for furniture, e.g. wardrobes, which are guided in lateral guides having a spring-loaded element or a tension element taking up the door weight.

2. Description of the Related Art

Closing elements movable in a vertical direction are known, for example, from the German utility model DE 298 07 679 where, mounted on the upper closing element, there is a spring-loaded tension element whose force compensates the weight of the closing elements. This tension element can appropriately comprise a pneumatic spring or a helical spring.

If a helical spring is used, its variable forces must be compensated during the movement as is known, for example, from European patent EP 0 417 822 B. To allow the bias of the spring to be varied in line with the function of the door, it is provided here that the free end of the spring be anchored on the furniture body by means of an adjustable mounting device. However, this adjustment is only suitable for a small variation range of the door weight so that with different doors each with different weights, it is also necessary to use different springs.

SUMMARY OF THE INVENTION

It is therefore the object of the present invention to create a generic, compensatable actuating device for vertical sliding doors which can be adapted easily to different door dimensions or door weights without any exchange of components and which simultaneously allows the adjustment of the manner of movement of the doors.

This object is achieved with a generic actuating device having a combination of features including a tension element guided via a rocking lever on which a spring-loaded element acts at a position-changing hinge position. In accordance with this, the spring acts on the rocking lever transmitting the door weight.

This hinge position can preferably be adjustable in two directions at right angles to each other. By means of this design, it is possible to modify the spring force and/or its distance to the pivot point of the rocking lever so that the torque exerted by this can be adjusted both in the opening and closing position of the door in such a way that it always compensates the weight of the closing elements. Preferred aspects of the invention include having the hinge position adjustable in the plane of the rocking lever, and having the hinge position on the rocking lever be adjustable in two directions at right angles to one another. The actuating device may include a cable which serves as the tension element and which acts with one end on the closing element, being guided around a return pulley fixed on a body and around a return pulley disposed on the rocking lever, and mounted with its other free end on the body. The hinge position for the free end of the cable on the body may be a rotatably pivoted pin on which the cable can be wound by turning. The rotatably pivoted pin can be turned via a worm screw. The spring of the, actuating device may be a helical spring which is hinged with its end opposite the hinge position on the rocking lever to a pin rotatably pivoted on a fixed body, by means of which the bias of the helical spring may be adjusted. Furthermore, the hinge position for the helical spring can be adjusted on the rocker lever via two screw pins disposed essentially perpendicularly to each, such screw pins interacting with worm screws.

By an appropriate compensation of the adjustment of the hinge point in both directions, it is partially possible to modify the torques in different regions in such a way that the movement of the closing elements is, for example, accelerated at the start and slowed at the end of the movement.

In accordance with one particularly preferred embodiment of the invention, it is additionally provided that the total swivel arc of the rocking lever can also be adjusted in relation to the direction of the force exerted by the door weight so that the torque to be compensated by the spring can also be modified in a small range. This is effected by the adjustment of the effective length of the cable forming the flexible tension element.

Another preferred aspect results from the actuating device, in accordance with which the spring acts on a lever coupled with the rocking lever which lever is movably supported with respect to the rocking lever. This solution may include further preferred aspects. Accordingly, the spring can be a pneumatic spring. The spring can act swivellably with one end on the lever and with the other end swivellably and movably on a support piece fixed on the body of a piece of furniture. Particularly advantageously, the rocking lever possesses on its free end a return pulley and on the opposite end it is supported swivellably in a support piece fixed on the body of a piece of furniture, while the additional lever, on which the spring is hinged, is supported on the one side movably in the support piece fixed on the body of a piece of furniture and, on the other side, rests with its free end on the rocking lever by means of a pulley.

Another independent solution of the object previously set results when the tension element accepting the closing element weight is connected to at least one counterweight guided in vertically running guides.

In accordance with further preferred embodiments, a further counterweight can be hung on the counterweight compensating the weight of the at least one closing element, which further counterweight ensures the required force for the maintaining of the closed position of the closing element. After the opening of the closing element, when this additional force is no longer required, advantageously a compensation means can be provided for the compensation of this additional counterweight. Such a compensation element can, for example, comprise a stop on which the additional counterweight is supported so that after a corresponding compensation of the additional counterweight the counterweight compensating the closing element now only works alone. In this case, it is therefore prevented that the closing element is pulled up when not wanted. Due to the balance with the pressing counterweight, it rather remains in the position in which it is left after pushing up a certain distance.

The weight can also comprise a steel container fillable with ballast. Here, therefore, the weight of the at least one closing element can be compensated depending on requirements.

BRIEF DESCRIPTION OF THE DRAWINGS

Further details and advantages of the invention are described in more detail by means of the embodiments shown in the drawings in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
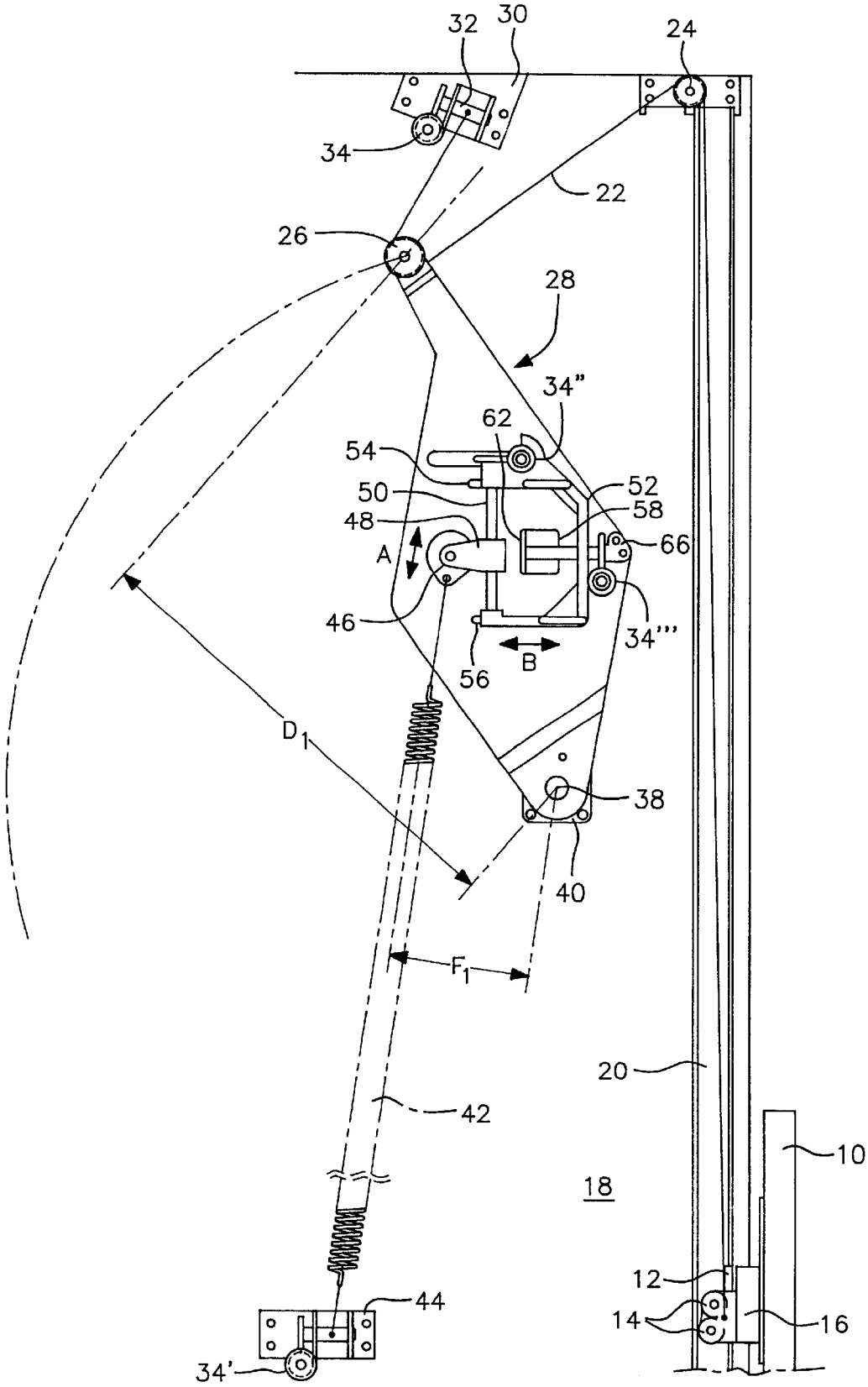
FIG. 1: shows a representation of the actuating device in accordance with the invention in which the wing is shown in the closed position.

In FIG. 1 the wing which there represents a door wing of an opening to be closed of a body of a piece of furniture is shown in a closed state. The wing 10 is guided movably by guide elements 16 provided with rollers 12, 14 in a straight guide 20 mounted on a side panel 18. On the upper guide element 16 of the wing 10, a flexible cable 22 is attached which via a return pulley 24, which is hinged in the upper region of the guide 20 to the body of the piece of furniture, and via a return pulley 26, which is supported on the extreme end of a rocking lever 28, runs to a fixed point on a support piece 30 fixed on the body of a piece of furniture. Here, the cable 22 is fixed in a continuous lateral borehole of a rotatably pivoted pin 32. The cable can be wound around this rotatably pivoted pin 32 so that the effective length of the cable is easy to change. In this way, the swivel arc of the rocking lever 28, as represented by a dot-dash line in FIG. 1, can be changed.

Figure 7:
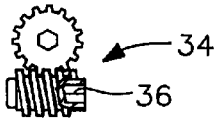
Figure 8:
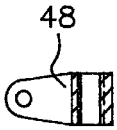

To actuate the pin 32, the gear with a worm screw 34 represented by way of example in FIG. 7 is provided, with a hexagonal Allen key being able to be inserted in a corresponding opening 36. This gear shown in FIG. 7 is implemented in all adjustment devices of this actuating device and is not described again in detail in the following description.

Figure 2:
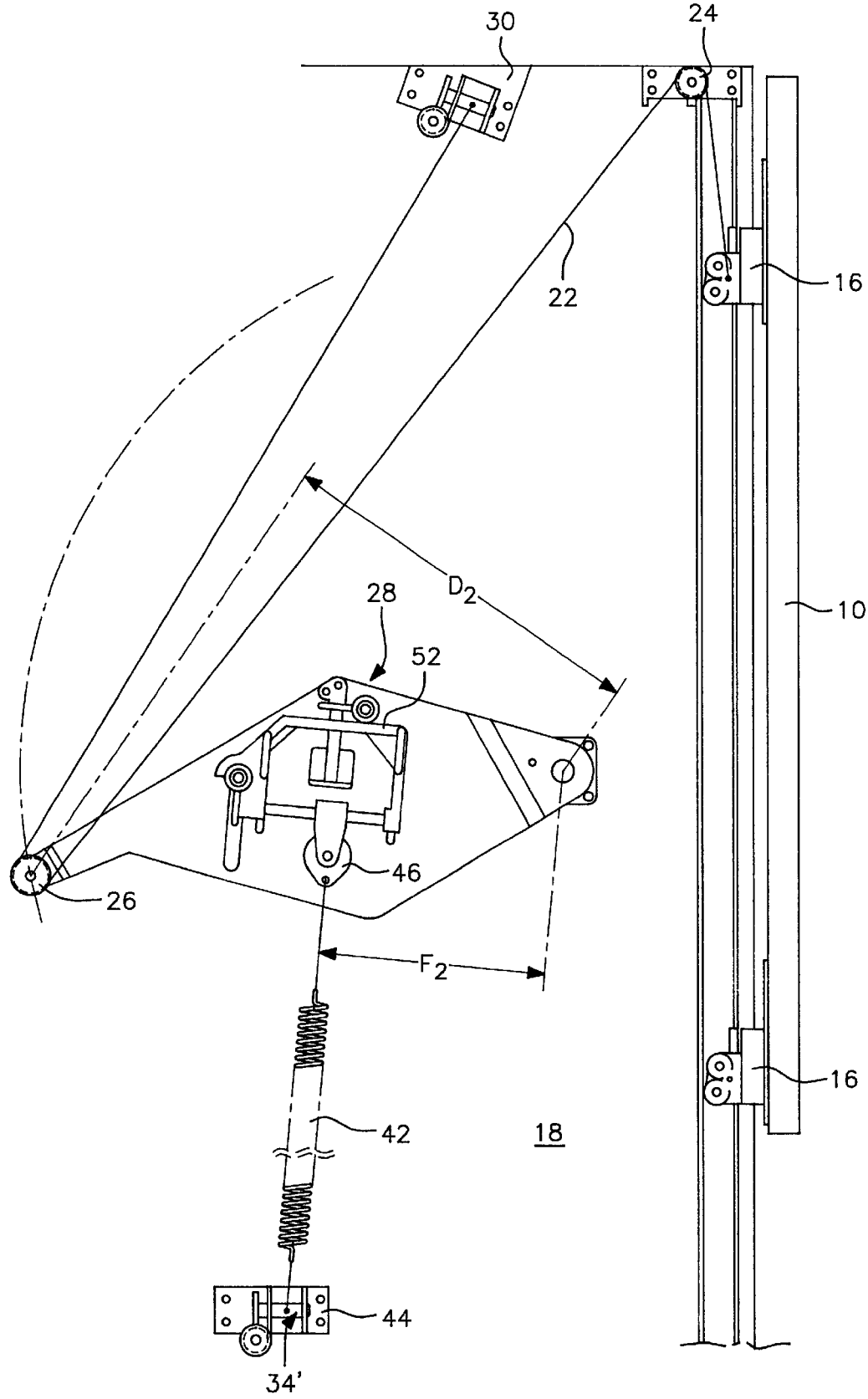
FIG. 2: shows the actuating device of FIG. 1 with an opened door wing.

It can be seen from FIGS. 1 and 2 that the torque exerted on the rocking lever 28 by the door weight depends on the length of the cable 22 and that by the adjustment of the cable the torque on the opening position of the door is more or less reduced, as is made clear by the distance D1 in FIG. 1 and D2 in FIG. 2. In the state shown, by an extension of the cable 22 the distance D1 is increased and the distance D2 reduced as the rocking lever 28 in the drawing representation is turned slightly to the left around a bolt 38 of a support piece 40 fixed on the body of a piece of furniture.

In a corresponding manner, by means of a gear with a worm screw 34', a helical spring 42 is also mounted on the support piece 44 screwed together with a side panel 18 of the wardrobe so that the spring force of the helical spring can be changed in a known manner.

Figure 3:
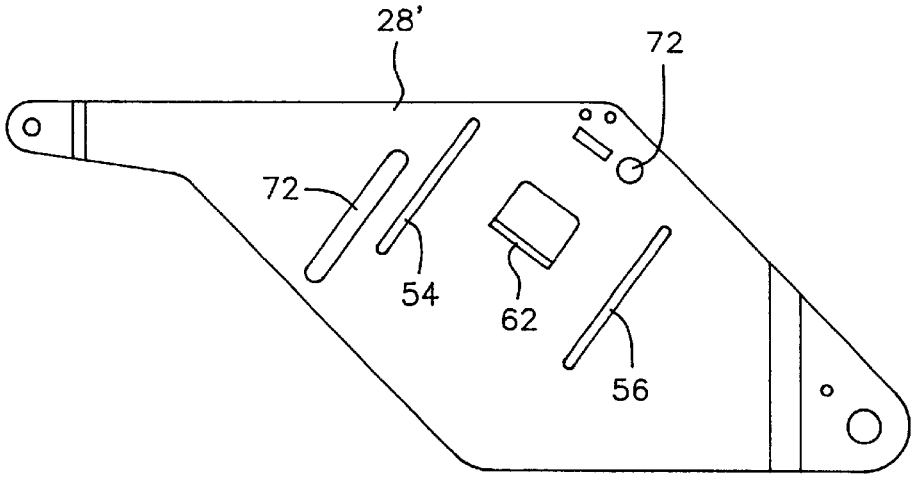
FIG. 3: shows a side view of the rocking lever of the embodiment of the actuating device shown here.
Figure 5:
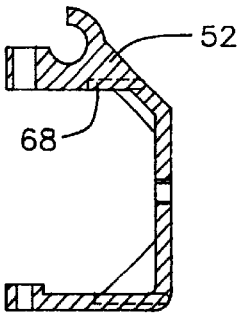
FIGS. 5 to 9: show different parts of the rocking lever, partially in section.
Figure 6:
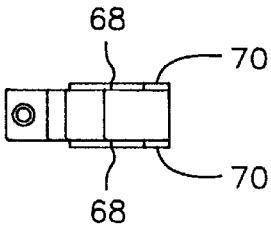
Figure 9:
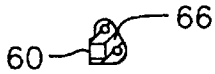
Figure 10:
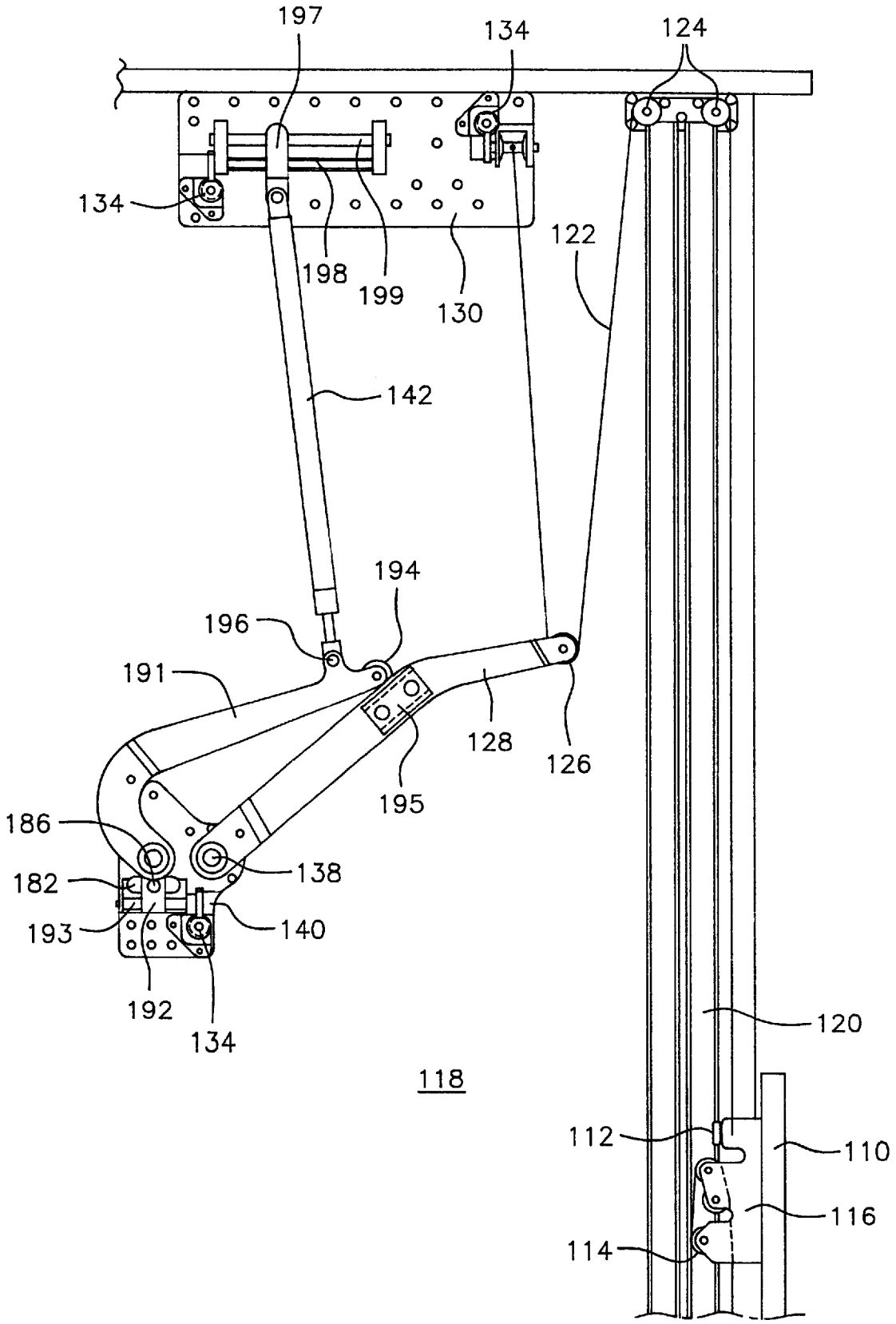
FIG. 10: shows a representation of another actuating device in accordance with the invention in which the wing is shown in the closed position.
Figure 11:
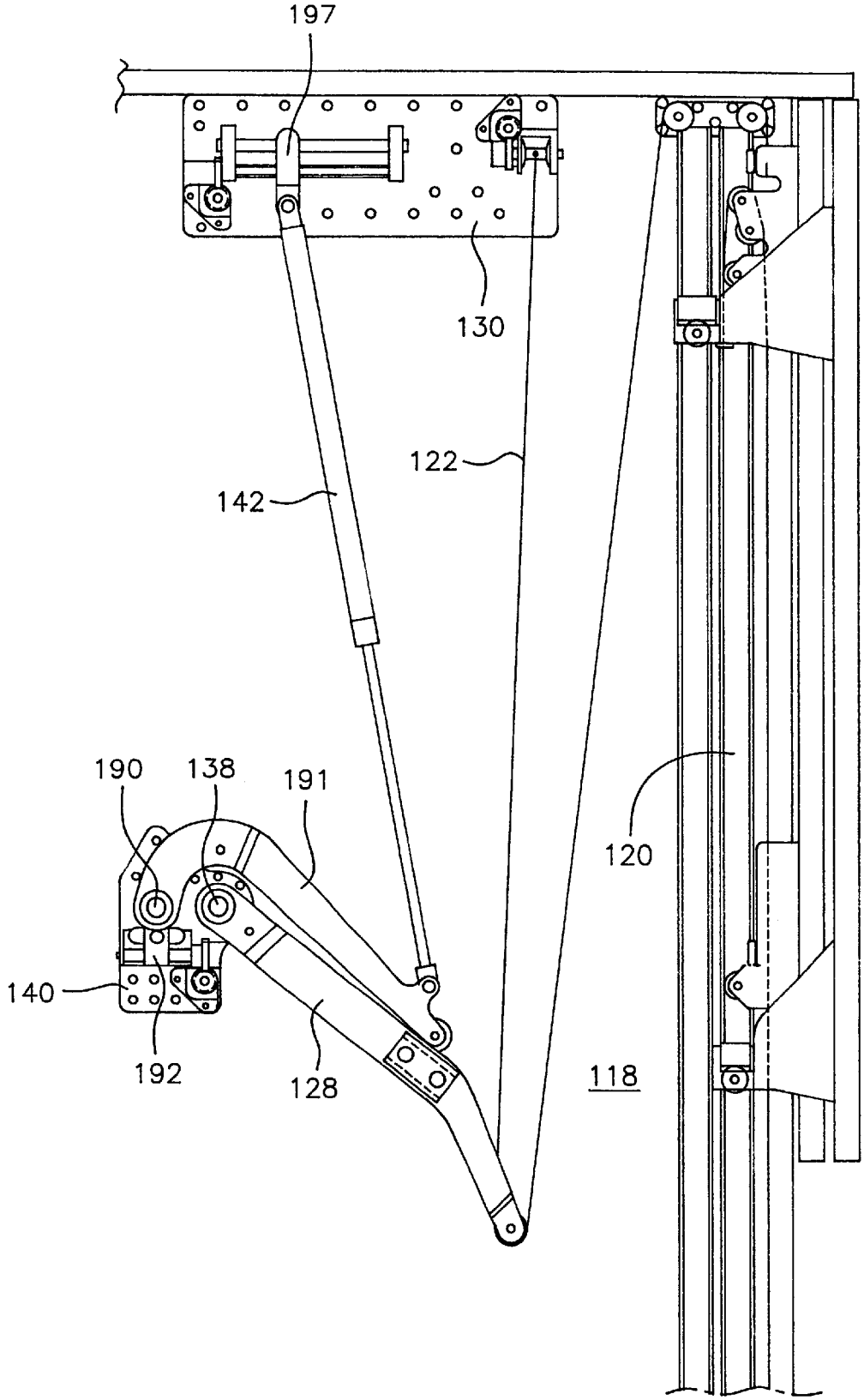
FIG. 11: shows the actuating device of FIG. 10 with an opened door wing.
Figure 12:
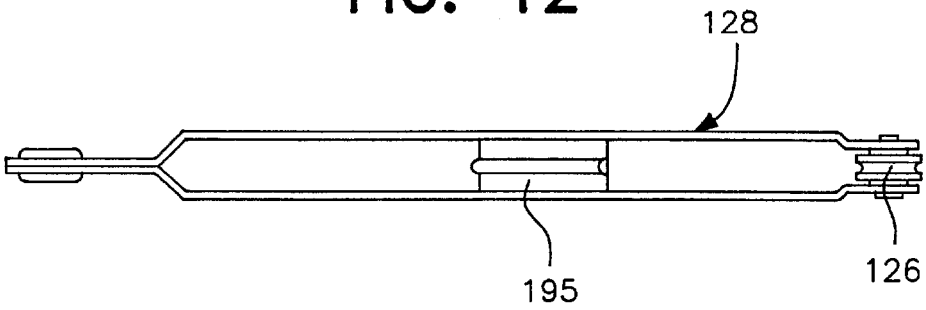
FIGS. 12 to 19: show different parts of the rocking lever, partially in section.
Figure 13:
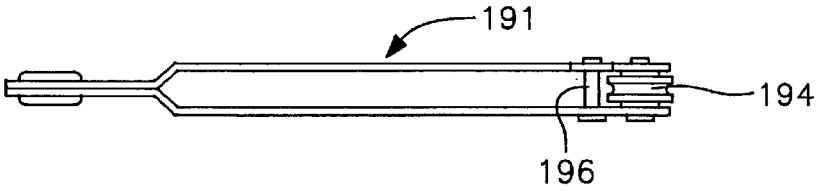
Figure 14:
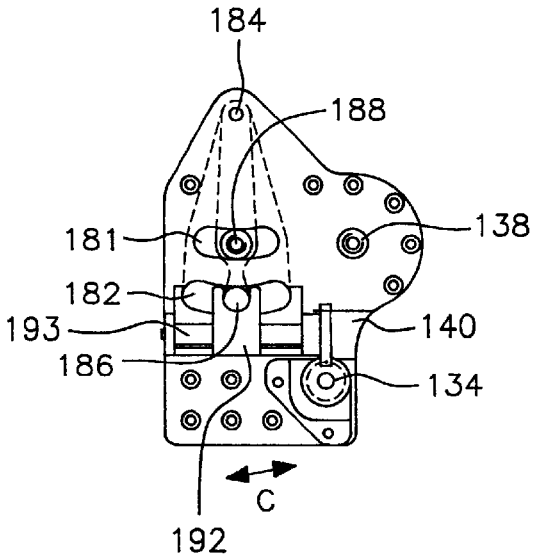
Figure 15:
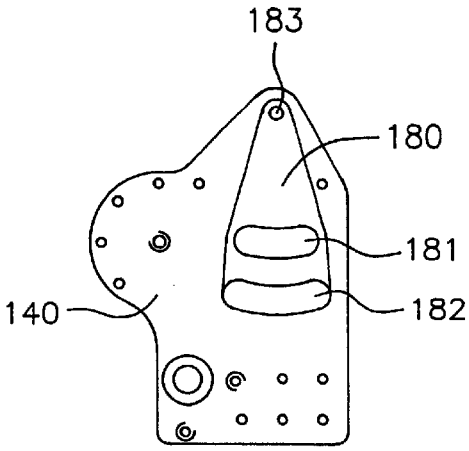
Figure 16:
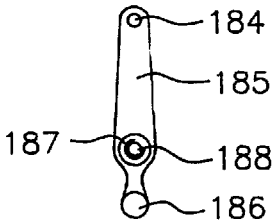
Figure 17:
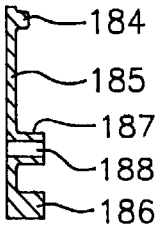
Figure 18:
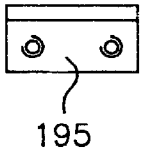
Figure 19:
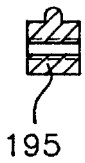

The other end of the helical spring 42 is connected via a pulley 46 to a member 48 which is movable in the direction of the double arrow A in FIG. 1 by means of a screw pin 50 which can also be actuated by a device 34". The screw pin 50 is supported with the associated worm screw 34" on a C-shaped slide 52 which can be moved in the direction of the double arrow B in FIG. 1 in guide slots 54, 56 of the rocking lever 28 by a screw pin 58 with a corresponding worm screw 34". The screw pin 58 is, on the one hand, rotatably supported in a borehole 60 of a tang 62 bent down from the rocking lever 28 and, on the other hand, in a borehole 64 of a block 66 riveted or screwed in boreholes 76 with the rocking lever 28. The block 66 with its borehole 60 is shown in FIG. 9. The slide 52, which is also shown in FIGS. 5 and 6, possesses side ribs 68, 70 which slide into the guide slots 54 and 56 of the rocking lever 28 (see also FIG. 3). The worm screws 34" and 34'" are accessible for their actuation in each case by the slot 72 and the borehole 74 in the rocking lever 28 (see FIG. 3).

Figure 4:
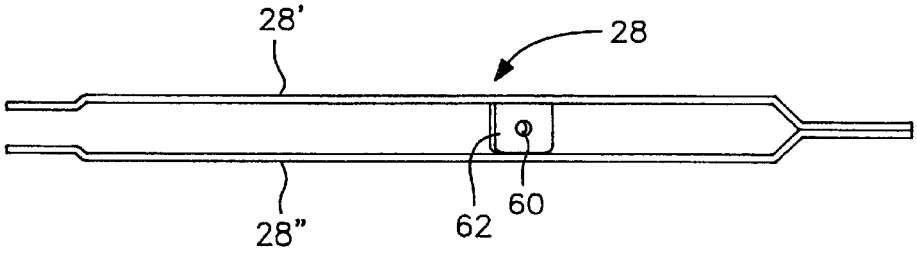
FIG. 4: shows a top view of the rocking lever.

It is most clearly visible from FIG. 4 that the rocking lever 28 consists of two mirror-symmetrical parts 28' and 28" which contain all adjustment devices for the helical spring so that the rocking lever forms in total with the adjustment devices one assembly. Thanks to the adjustment in both directions in accordance with the double arrows A and B in FIG. 1, it is possible to modify both the spring force and the distance F1 or F2 in the closing and opening direction of the closing element in each case in order to achieve the desired effect.

In the embodiment shown in FIGS. 10 to 19, the wing 110 is also guided movably in a guide 120 mounted on the side panel 118 by means of guide elements 116 provided with rollers 112, 114. The cable 122 fixed on the guide element 116 runs over fixed return pulleys 124 and a pulley 126 supported on the extreme end of the rocking lever 128 to a fixed point on a support piece 130 fixed on the body of a piece of furniture, with a gear being provided for the adjustment of the cable length.

The other end of the rocking lever 128 is rotatably pivoted around a bolt 138 of a support piece 140 fixed to the body of a piece of furniture. This support piece 140 possesses a rear recess 180 in which two concentric, circle arc-shaped grooves 181, 182 and a borehole 183 lying in its radius centre are provided (see FIGS. 14 and 15).

In the borehole 183, the journal 184 of a lever 185 is supported which is guided in the groove 182 by a journal 186 provided on its other end and which also possesses a centre journal 187 with a mounting borehole 188 which penetrates the groove 181. In this mounting borehole 188, the cap bolt 190 for another rocking lever 191 is screwed in. The outer journal 186, which in turn protrudes over the groove 182, is partially encircled by the fork-shaped end of a member 192 which can be moved in the direction of the double arrow c in FIG. 14 by a screw pin 193 which can also be actuated by an adjustment device 134. In this way, the distance between the bolts 190 and 138 can therefore be changed.

The outer end of the rocking lever 191 is provided with a roller 194 which is supported on a guide stand 195 mounted on the rocking lever 128. In the vicinity of the roller 194, the rocking lever 191 possesses a lateral pin 196 supported in boreholes of lateral tangs which pin serves to support one end of a pneumatic spring 142 whose other end is mounted on a further member 197 which can be actuated by a screw pin 198 and a guide pin 199.

In the new embodiment, the direction or the arm of the spring force can thus be changed by the member 197. As the stroke of the pneumatic spring is, however, necessarily limited, a support pin 196 must be disposed between the bolt 138 and the roller 126 in order to allow a sufficient swivel of the outer end of the rocking lever 128. If the pneumatic spring 142 were supported on the same rocking lever 128, the arm of the spring would be essentially modified in its length during the swivel due to its small radius. In accordance with the basic idea in accordance with the invention, however, the pneumatic spring 142 is supported on a flirter rocking lever 191 whose swivel bolt 190 is disposed in such an offset manner to the bolt 138 that the position of the arm of the pneumatic spring 142 changes less in relation to the bolt 138. An adjustment of the arm is, however, possible by means of the member 192.

Figure 20:
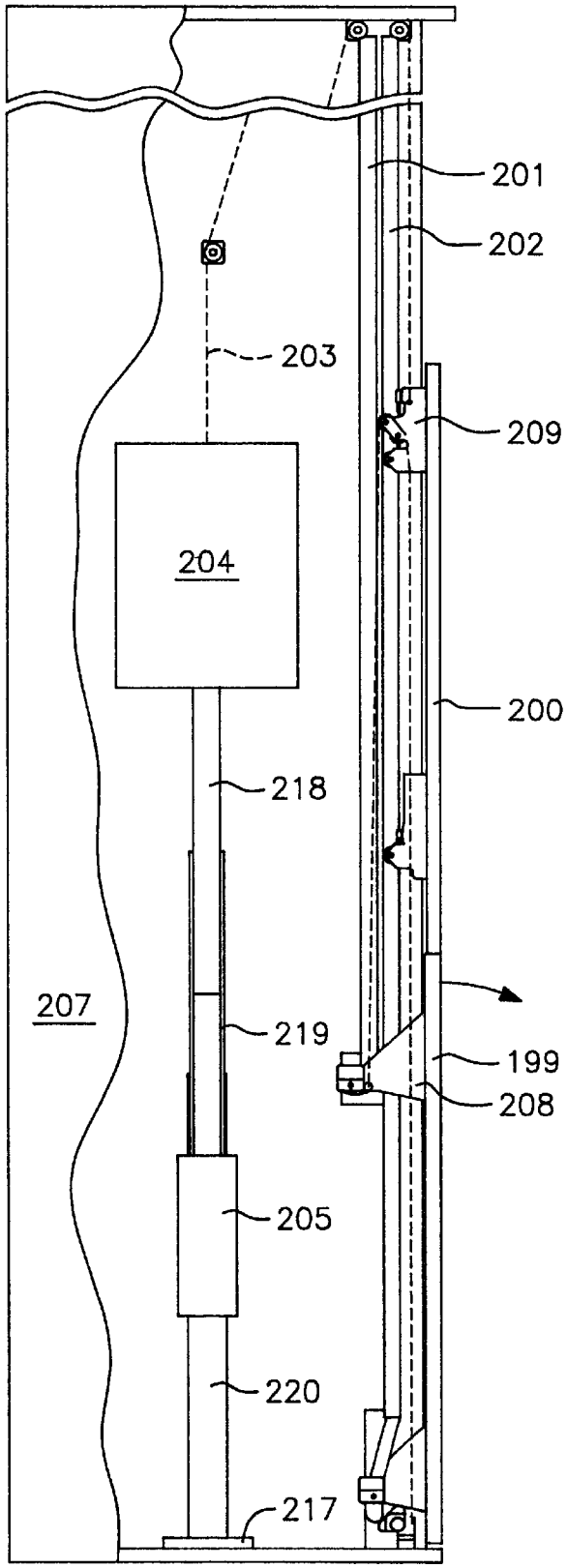
FIG. 20: shows a representation of a further actuating device in accordance with the invention in which two wings are shown in the closed position.
Figure 21:
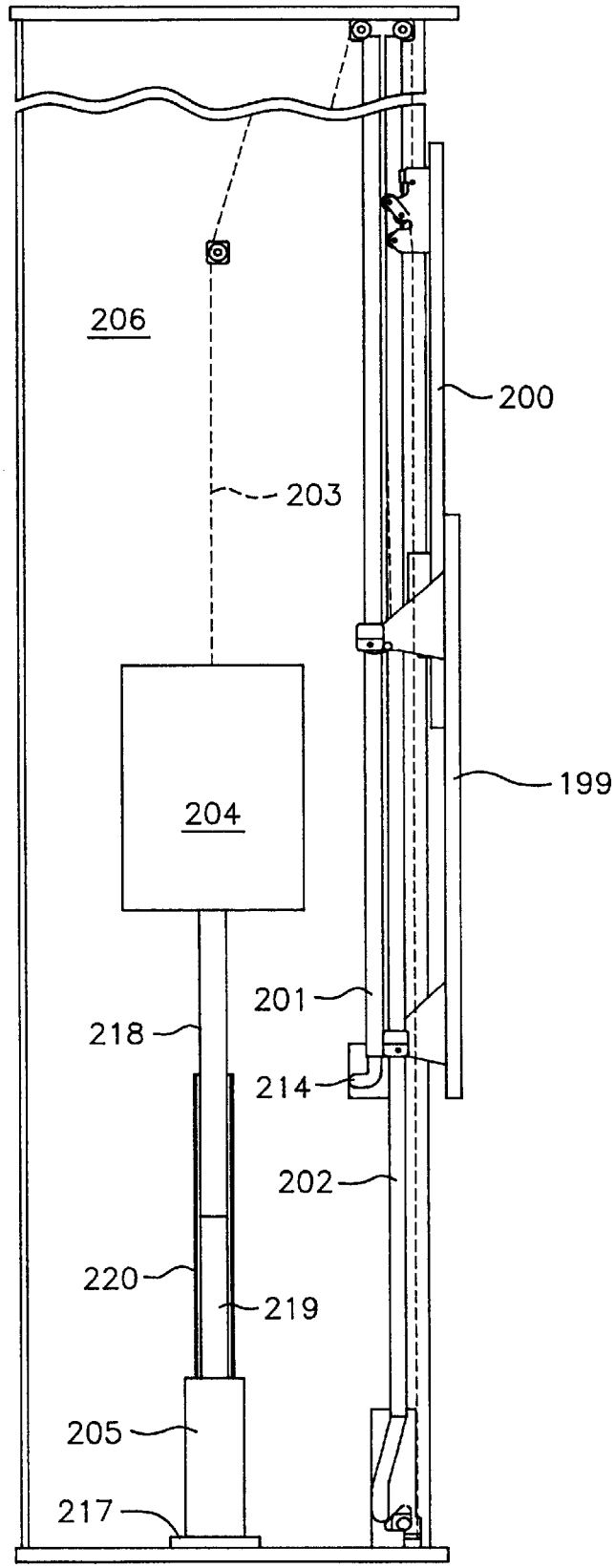
FIG. 21: shows the actuating device of FIG. 20 with partially opened door wings.
Figure 22:
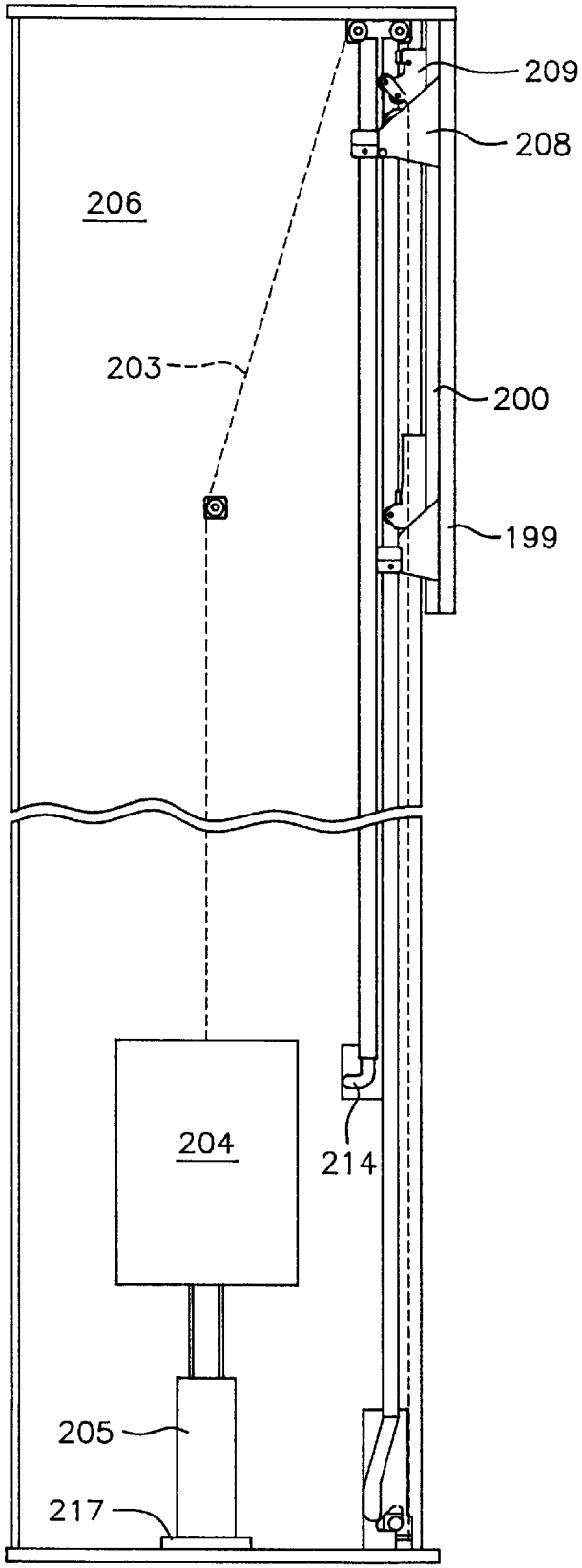
FIG. 22: shows the actuating device of FIGS. 20 and 21 with fully opened door wings.

In FIGS. 20, 21 and 22, an embodiment with two wings 199, 200 to be opened is shown. The wings 199 and 200 are essentially in a common plane in their closed position which is shown in FIG. 20. The lower wing 199 can be pulled out of the common plane in the direction of the arrow by swivelling so that it can be travelled above the wing 200 disposed above it as can be seen from the partially opened position in FIG. 21 and the fills opened position in FIG. 22. In the opened position (see FIG. 22), the wings 199, 200 are in alignment and parallel to each other.

On the upper wing 200, a tension element 203 is mounted which has a force applied to it compensating the weight of the wings 199, 200. In the embodiment shown here, this force is made available by counterweights 204, 205 which are guided in vertically running guides on the side panels.

Figure 23:
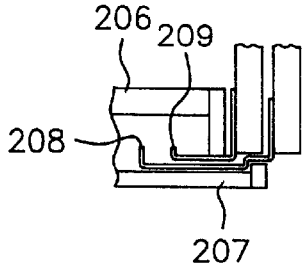
FIGS. 23 to 25: show different parts or details of the actuating device and the guide of the wings.

The wings 199, 200 are guided via guide pieces 208, 209 in guides 201, 202. Appropriately, the guides 201, 202 for the guide pieces 208 and 209 and the tension element 203 and the counterweights 204, 205, etc. are disposed on outer sides 206 of wardrobes in a space which is then covered by a top plate 207 as is, for example, shown in FIGS. 20 and 23. In this way, the inner space of the wardrobe can be used to the full.

Figure 24:
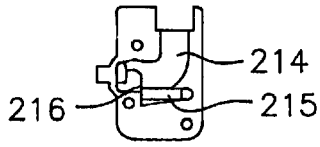
Figure 25:
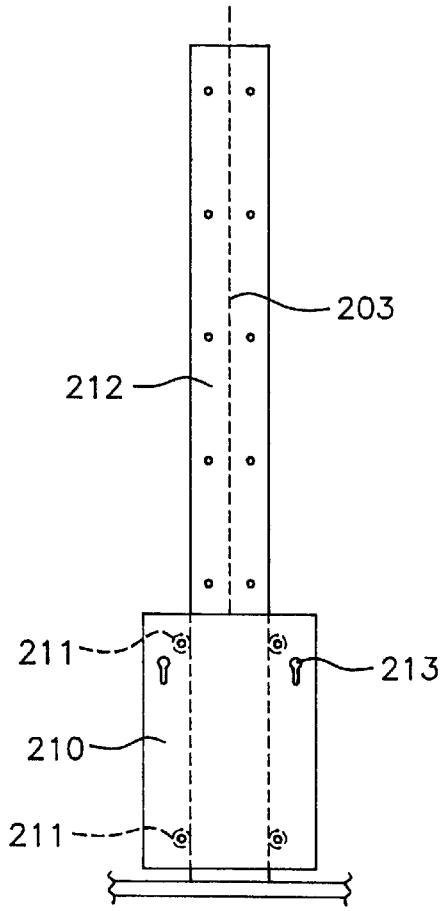

The counterweights can consist of a single steel plate 210 which is guided by rollers 211 laterally on a fixed guide track 212 and is provided with keyhole-shaped boreholes 213 for the affixing of additional compensation weights (see FIG. 25). In this case, the sections 214 of the guides 201 running at right angles to the moving direction are provided with springy tangs 215 and elastic shock absorbers 216 or also with magnets (not shown) which hold the guide pieces 208 in their closed position (see FIG. 24) as a sufficient force directed upwards is missing which would press the guide pieces into the snap recesses.

The counterweights can consist of a steel container which can be filled with any ballast depending on the weight of the wings 199, 200.

In accordance with a preferred embodiment shown in FIGS. 20 to 22, it is, however, provided that a further, lesser counterweight 205 is hung on the compensating counterweight 204 which ensures the required force for the closed position. In this case, the closing elements are automatically pulled upwards at the beginning of the opening movement, as can be seen from FIG. 20. After a short movement, the wings 199, 200 are located in the position visible from FIG. 21, with the additional counterweight 205 pressing against a stop 217 or the bottom and thus being compensated so that the closing elements 199, 200 have only the counterweight 204 applied to them, are thus compensated and can selectively come to rest in different positions up to the opening position of FIG. 22.

In accordance with a further development of the invention, the counterweight 204 can be mounted on a pull-out rail 218 of a pull-out guide for drawers or similar, while the additional weight 205 is connected to a central rail 219 and the body rail 220 is screwed onto the side panel 206. In the position of FIG. 20, the central rails 219 are hung on the pull-out rails by carriages. The pull-out mechanism of drawer guides is known per se and therefore does not need to be described in detail.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. An actuating device comprising a closing element movable in a vertical direction for an opening in a body, said closing element being guided in lateral guides, a tension element guided via a rocking lever, and a spring loaded element taking up a weight of said closing element and acting at a position-changing hinge position of said rocking lever, one end of the rocking lever being pivotally attached to the body and the other end of the rocking lever being connected to the tension element, said hinge position on the rocking lever being independently adjustable in two directions substantially at right angles to each other such that adjustment in one direction does not necessitate adjustment in the other direction.

2. The actuating device in accordance with claim 1, wherein the hinge position is adjustable in the plane of the rocking lever.

3. The actuating device in accordance with claim 1, wherein the spring loaded element is a helical spring which is hinged at its end opposite the hinge position on the rocking lever, to a pin rotatably pivoted on the body, by means of which a bias of the helical spring can be adjusted.

4. The actuating device in accordance with claim 3, wherein the hinge position for the helical spring can be adjusted on the rocker lever via two screw pins disposed essentially perpendicularly to each other, which screw pins interact with worm screws.

5. An actuating device for a closing element movable in a vertical direction comprising an opening in a body, said closing element being guided in lateral guides, a spring-loaded element for taking up a weight of said closing element, a rocking lever, and a tension element guided via said rocking lever, the spring-loaded element acting at a position-changing hinge position of said rocking lever, wherein a cable serves as the tension element, which cable acts with one end on the closing element, is guided around a first return pulley fixed on the body and around a second return pulley disposed on the rocking lever and is mounted with its free end on the body.

6. The actuating device in accordance with claim 5, wherein the hinge position for the free end of the cable on the body is a rotatably pivoted pin on which the cable can be wound by turning.

7. The actuating device in accordance with claim 6, wherein the rotatably pivoted pin can be turned via a worm screw.

8. The actuating device in accordance with claim 5, wherein the spring loaded element acts on the rocking lever through a second rocking lever that is coupled with the rocking lever, said second rocking lever being movably supported in relation to the rocking lever.

9. The actuating device in accordance with claim 8, wherein the spring loaded element is a pneumatic spring.

10. The actuating device in accordance with claim 9, wherein the pneumatic spring acts with one end swivellably on the second rocking lever and with the other end swivellably and movably on a support piece fixed on the body, the body being a piece of furniture.

11. The actuating device in accordance with claim 8, wherein the rocking lever possesses on its free end a return pulley and is supported on its opposite end in a support piece fixed on the body and wherein the second rocking lever, on which the spring loaded element is hinged, is movably supported on one end by the support piece fixed on the body while the other end of the second rocking lever rests on the rocking lever via a roller.

12. An actuating device comprising a closing element movable in a vertical direction for an opening in a body, said closing element being guided in lateral guides, a tension element guided via a rocking lever, and a spring loaded element taking up a weight of said closing element and acting at a position-changing hinge position of said rocking lever, one end of the rocking lever being pivotally attached to the body and the other end of the rocking lever being connected to the tension element, said spring loaded element acting on the rocking lever through a second rocking lever that is coupled with the rocking lever, said second rocking lever being movably supported in relation to the rocking lever.

13. The actuating device in accordance with claim 12, wherein the spring loaded element is a pneumatic spring.

14. The actuating device in accordance with claim 13, wherein the pneumatic spring acts with one end swivellably on the second rocking lever and with the other end swivellably and movably on a support piece fixed on the body, the body being a piece of furniture.

15. The actuating device in accordance with claim 12, wherein the rocking lever possesses on its free end a return pulley and is supported on its opposite end in a support piece fixed on the body and wherein the second rocking lever, on which the spring loaded element is hinged, is movably supported on one end by the support piece fixed on the body while the other end of the second rocking lever rests on the rocking lever via a roller.

16. An actuating device comprising a closing element movable in a vertical direction for an opening in a body, said closing element being guided in lateral guides, a tension element taking up a weight of said closing element, said tension element being connected to a first counterweight which is guided in guides running vertically and to an additional counterweight hung below said first counterweight, said additional counterweight being rendered ineffective after a certain opening movement of said closing element such that only the first counterweight acts thereafter on said closing element.

17. The actuating device in accordance with claim 16, wherein the additional counterweight is rendered ineffective by a stop on which the additional counterweight is supported.

18. The actuating device in accordance with claim 16, wherein the first counterweight consists of a steel container fillable with ballast.

19. The actuating device in accordance with claim 16, wherein said closing element can come to rest in different positions up to a full opening position upon said additional counterweight becoming ineffective.

* * * * *